US005657562A

United States Patent [19]

Desormeaux

[11] Patent Number: 5,657,562

[45] Date of Patent: Aug. 19, 1997

[54] CARD WITH A PRECUT REPRESENTATION OF A KNOWN PERSONAGE AND A PRECUT SUPPORTING BAND INTERLOCKABLE THEREWITH

[75] Inventor: Richard Desormeaux, Laval, Canada

[73] Assignee: Studio 2+2 Inc., Outremont, Canada

[21] Appl. No.: 560,882

[22] Filed: Nov. 20, 1995

[30] Foreign Application Priority Data

Nov. 23, 1994 [CA] Canada ..... 2136518

[51] Int. Cl.[6] ..... G09F 1/00

[52] U.S. Cl. ..... 40/124.01; 40/539; 40/488

[58] Field of Search ..... 40/124.1, 539, 40/538, 761; 446/387, 488

[56] References Cited

U.S. PATENT DOCUMENTS

| | | | |
|---|---|---|---|
| 2,902,176 | 9/1959 | Wathen | 40/124.1 X |
| 3,589,046 | 6/1971 | Taub | 40/124.1 |
| 3,753,312 | 8/1973 | Hughes, Jr. | 446/387 |
| 5,010,669 | 4/1991 | Moran | 40/124.1 X |

FOREIGN PATENT DOCUMENTS

| | | | |
|---|---|---|---|
| 1210312 | 2/1966 | Germany | 40/124.1 |

*Primary Examiner*—Brian K. Green
*Attorney, Agent, or Firm*—Robic

[57] ABSTRACT

The card is preferably made of cardboard and has two precut elements. The first one has an elongated rectangular base from which projects a representation of a known personage, preferably a showbusiness or sports star, which is printed on one or both sides of the card. The base has two opposite ends in which transverse slots are precut. The second element precut in the card is in the shape of an elongated rectangular band foldable at mid-length, which has two opposite ends in which slots are also precut. The slots of the base and the band are positioned so that, when the first and second elements have been cut and the band has been folded at mid-length, the slots of the band are engageable into the slots of the base of the first element to fix the band to the base and thus forms a triangular support from which the representation of the known personage extends perpendicularly. Positioning of this support on a horizontal surface gives a standing full length portrait of the personage on this horizontal surface. Preferably, the card also has other printings on it, including the name of the known personage and some written information on it.

12 Claims, 2 Drawing Sheets

CARD WITH A PRECUT REPRESENTATION OF A KNOWN PERSONAGE AND A PRECUT SUPPORTING BAND INTERLOCKABLE THEREWITH

BACKGROUND OF THE INVENTION a) Field of the Invention

The present invention relates to a card made of a rigid or semi-rigid material, such as cardboard, on which are printed a representation of a known personage and a supporting band which both are precut and devised to be interlocked so that, after cutting and interlocking, one may obtain a self-standing portrait of said personage.

b) Brief Description of the Prior Art

Cards made of cardboard or other similar material are already known, which comprise precut elements printed on their surface and devised to be interlocked to each other after they have been cut out, in order to form three dimensional objects. Cards of this type are usually on sale during Christmas, with precut elements which, when assembled, together form self-standing Christmas crib or tree that can be positioned onto a flat horizontal surface, such a table or a shelf.

Cards are also known, on which a representation of a known personage, such as a showbusiness star or a sports hero is printed. These cards are intended to be collected by fans and usually comprise a short written information on the personage whose portrait or reproduction is printed. This information can be, for example, a résumé of the career of the personage and/or a list of the trophies he or she won. By way of examples, one can mention hockey cards or baseball cards that hockey or baseball fans like to collect.

The drawback of these cards representing known personages is essentially that they are in two dimensions only. Accordingly, they can be displayed only when they are attached to a vertical surface, such as a wall.

In practice, numerous fans of a known personage would like to have a full length representation of their favorite star, which they could display in the a self-standing position onto their desk or onto a shelf.

SUMMARY OF THE INVENTION

The object of the present invention is to provide a card which overcomes the above mentioned drawback.

More particularly, the object of the invention is to provide a card on which is printed and precut a representation of a known personage which, when it is cut and interlocked with a supporting band which is also printed and precut in the same card, allow for the representation to be positioned in a self-standing position onto an horizontal planar surface, such as a desk, a table or a shelf.

The invention as claimed is directed to a card that is made of a rigid or semi-rigid material, and comprises two precut portions, exclusively, which, once they are detached, respectively form:

- a first element comprising an elongated rectangular base of given height from which projects a flat member containing a two-dimension representation of a known personage printed on at least one side of the card, this base having two opposite ends and two transverse slots precut therein near the ends thereof, along half of the height of the base said flat member having a size and a shape corresponding to said representation; and
- a second element in the form of an elongated rectangular band which is foldable at mid-length, this band having a height substantially equal of the height of the base, the band also having two opposite ends and two transverse slots precut therein near the ends thereof along half of the height of the band.

The slots of the base and the band are positioned so that, when the first and second elements have been cut out and the second element in the form of a band has been folded at mid-length, the slots of the band are engageable into the slots of the base of the first element to fix the band to the base, the band and the base then forming together a triangular support from which the flat member containing the representation of a known personage extends perpendicularly.

As a result, positioning of the support on a horizontal surface results in a self-standing portrait of the personage on this horizontal surface.

According to a preferred embodiment of the invention, the card may also comprises other printings on at least the one side thereof where is printed the representation of the known personage. This other printing may include the name of the known personage and written information on the same.

BRIEF DESCRIPTION OF THE DRAWINGS

The invention will be better understood upon reading the following non-restrictive description of a preferred embodiment thereof, made with reference to the accompanying drawings in which.

DESCRIPTION OF A PREFERRED EMBODIMENT

Figure 1:
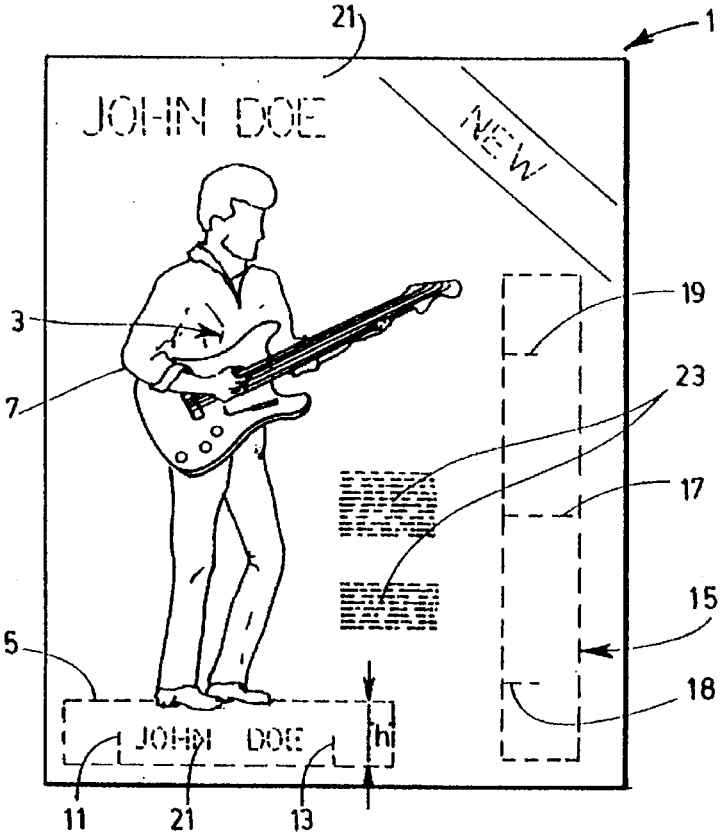
FIG. 1 is a front elevational view of a card according to the invention.
Figure 2:
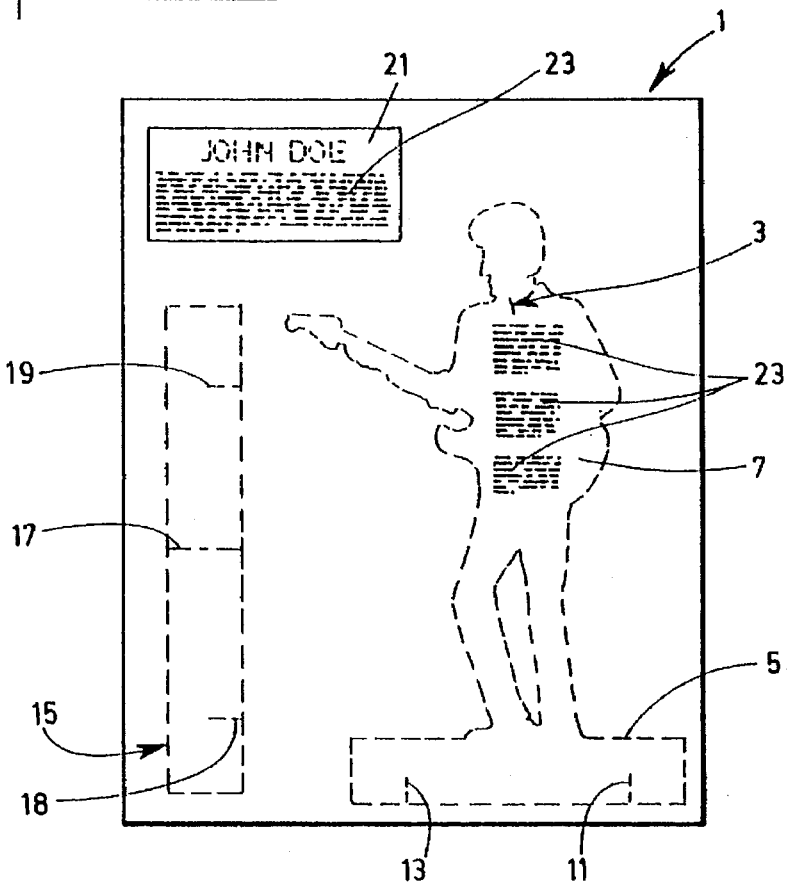
FIG. 2 is a rear elevational view of the card shown in FIG. 1.

The card 1 that is shown in front and rear elevational views in FIGS. 1 and 2, respectively, is made of a rigid or semi-rigid material, such as cardboard. Of course numerous other materials of the same type, such as thin plastic material sheets, could also be used. In fact, the only requirement concerning the material is that it be printable and have enough rigidity to be self-standing.

The card 1 comprises a first piece 3 comprising an elongated rectangular base 5 from which projects a flat member containing a two-dimension representation of a known personage such as a guitar player named John DOE in the illustrated embodiment. This reproduction is printed on at least one side of the card. Under certain circumstances, the back of the personage could also be printed on the other side of the card, making the flat member containing a two-dimension representation reversible.

The base 5 is of a given height "h" and has two opposite ends that are straight. At a short distance from both ends of the base, two small transverse slots 11, 13 are precut, which extend along half of the height "h" of the base.

The card 1 also comprises a second precut piece 15 in the shape of an elongated rectangular band 17 foldable at mid-length. This band 15 has a height substantially equal to the height "h" of the base 5. The band 15 also has two opposite ends that are straight. Once again, two small transverse slots 18, 19 are precut in the band at a short distance from the opposite ends thereof, along half of the height of the band.

The relative position of the first and second elements onto the card 1 is not an essential feature of the invention. In practice, such position is left to the designer or printer, depending on his or her need and/or requirements, usually based the general dimensions desired for the card.

Figure 3:
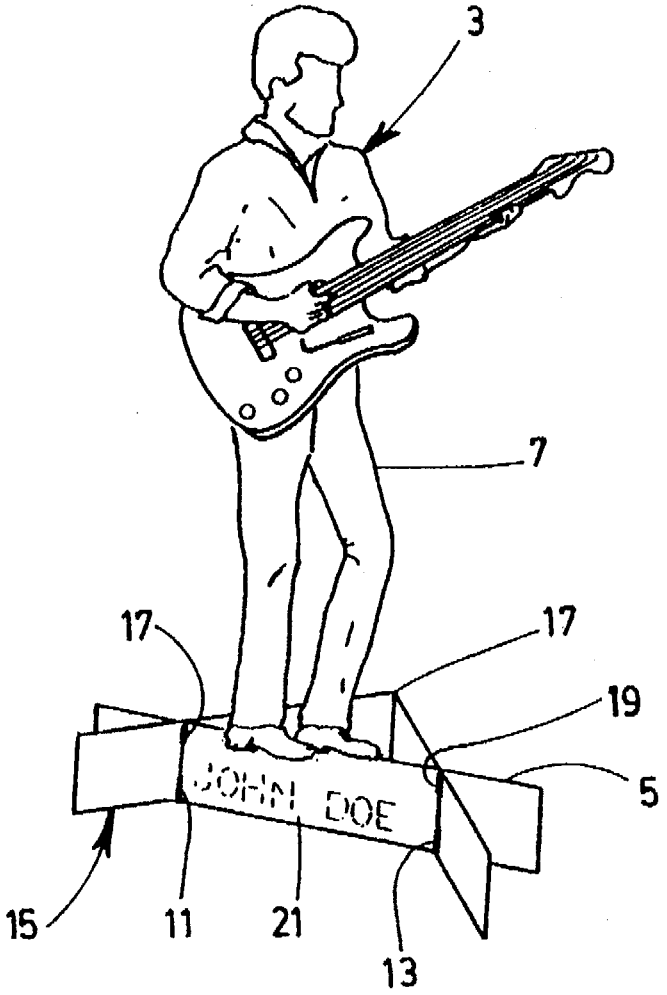
FIG. 3 is a perspective view of the product that is obtained once the elements of the card have been cut and interlocked.

In accordance with the invention, the slots of the band 15 and of the base 5 are positioned in such a manner that, when the fist and second pieces 3 and 15 have been precut and thus removed from the remaining of the card and the second piece 15 in the form of the band has been folded at mid-length 17, the slots 18 and 19 of the band 15 may engage the slots 11 and 13 of the base 5 of the first element to fix this band as is shown in FIG. 3.

Then, the base 5 and the band 15 together form a triangular support from which the representation 7 of the known personality extends perpendicularly.

As may now be understood, positioning of the support consisting of the base 5 and the band 15 interlocked into each other, directly onto a horizontal flat surface, gives a self-standing portrait of the personage of this surface.

Advantageously, the card may also comprise other printings on one or the other sides thereof, and preferably on both of them. These other printings may include the name 21 of the printed personage, John DOE and/or one or more written information 23 on him. Advantageously, at least one part of the writings 23 can be printed on the reverse portion of the representation as is shown in FIG. 2, to remain with the same, even after it has been cut out.

It must be understood that the known personage can be anyone. As a matter of fact, it can even be a cartoon or a caricature.

The card 1 according to the invention is particularly useful as a promotion tool or as a substitute for the cards presently used to promote showbusiness or sport heros and stars.

What is claimed is:

1. A card that is made of a rigid or semi-rigid material and comprises two precut portions exclusively, which respectively form onto said card:

a first element comprising an elongated rectangular base of given height from which projects a flat member containing a two-dimension representation of a known personage printed on at least one side of the card, said base having two opposite ends and two transverse slots precut therein near said ends along half of the height of said base, said flat member having a size and a shape corresponding to said representation; and a second element in the form of an elongated rectangular band, said band having a folding line at mid-length and a height substantially equal to the height of the base, said band also having two opposite ends and two transverse slots precut therein near the ends thereof along half of the height of said band;

the slots of said base and said band being positioned so that, when the first and second elements have been removed from the card and the second element in the form of a band has been folded at mid-length, the slots of the band are engageable into the slots of the base of the first element to fix said band to said base, said band and said base then forming together a triangular support from which said flat member containing said representation of a known personage extends perpendicularly;

whereby positioning of said support on a horizontal surface results in a self-standing portrait of said personage on said horizontal surface.

2. The card according to claim 1, comprising other paintings on at least said one side of the card where the representation of the known personage is printed.

3. The card according to claim 2, wherein said other paintings include the name of the known personage and some written information on it.

4. The card according to claim 3, wherein at least part of the written information on the known personage is printed on the side of the card that is opposite to the one side on which the reproduction is printed.

5. The card according to claim 4, wherein said rigid or semi-rigid material is a piece of cardboard.

6. The card according to claim 3, wherein said rigid or semi-rigid material is a piece of cardboard.

7. The card according to claim 6, wherein said known personage is a showbusiness or sports personage.

8. The card according to claim 3, wherein said known personage is a showbusiness or sports personage.

9. The card according to claim 2, wherein said rigid or semi-rigid material is a piece of cardboard.

10. The card according to claim 1, wherein said rigid or semi-rigid material is a piece of cardboard.

11. The card according to claim 10, wherein said known personage is a showbusiness or sports personage.

12. The card according to claim 1, wherein said known personage is a showbussiness or sports personage.

* * * * *